US008690023B2

(12) United States Patent
Santoni

(10) Patent No.: US 8,690,023 B2
(45) Date of Patent: Apr. 8, 2014

(54) DISPENSER WITH LIQUID FILM BLOCKING CAPABILITY

(75) Inventor: Giorgio Santoni, Spoltore (IT)

(73) Assignee: Emsar S.p.A., San Giovanni Teatino (CH) (IT)

( * ) Notice: Subject to any disclaimer, the term of this patent is extended or adjusted under 35 U.S.C. 154(b) by 0 days.

(21) Appl. No.: 13/513,243

(22) PCT Filed: Dec. 10, 2010

(86) PCT No.: PCT/IT2010/000495

§ 371 (c)(1),
(2), (4) Date: Jun. 1, 2012

(87) PCT Pub. No.: WO2011/074024

PCT Pub. Date: Jun. 23, 2011

(65) Prior Publication Data

US 2012/0228335 A1 Sep. 13, 2012

(30) Foreign Application Priority Data

Dec. 15, 2009 (IT) ..... RM2009A0660

(51) Int. Cl.
*B65D 88/54* (2006.01)

(52) U.S. Cl.
USPC ..... 222/321.9; 222/340

(58) Field of Classification Search
USPC ..... 222/320, 321.1, 321.7, 321.9, 384, 385, 222/340
See application file for complete search history.

(56) References Cited

U.S. PATENT DOCUMENTS

| | | | | | |
|---|---|---|---|---|---|
| 5,458,289 | A | * | 10/1995 | Cater | 239/119 |
| 5,772,078 | A | * | 6/1998 | Knickerbocker | 222/321.1 |
| 5,826,756 | A | | 10/1998 | Foster | |
| 5,899,363 | A | * | 5/1999 | Bliss et al. | 222/153.02 |
| 6,016,974 | A | * | 1/2000 | Mascitelli | 239/333 |
| 6,123,234 | A | * | 9/2000 | Lai | 222/321.7 |
| 6,357,629 | B1 | * | 3/2002 | Ding | 222/153.13 |

(Continued)

FOREIGN PATENT DOCUMENTS

| | | | |
|---|---|---|---|
| EP | 0 806 249 | A2 | 11/1997 |
| JP | 10 323588 | A | 12/1998 |

(Continued)

OTHER PUBLICATIONS

International Search Report, dated Apr. 11, 2011, from corresponding PCT application.

*Primary Examiner* — Kevin P Shaver
*Assistant Examiner* — Patrick M Buechner
(74) *Attorney, Agent, or Firm* — Young & Thompson

(57) ABSTRACT

A dispenser includes a hollow containment body (2) able to be inserted in a bottle and including an orifice (5) for the suction of liquid from the bottle, a ring nut (21), able to be screwed onto the neck of the bottle, including an annular shoulder (22) covering and associated to an annular lip (2*d*) of the containment body. The dispenser further includes a piston (10) able to slide within the containment body between a raised position and a lowered position, a hollow stem (7) axially able to slide within the containment body, associated inferiorly to the piston and superiorly to a dispensing spout (8) to command the actuation of the piston and dispense fluid contained in the bottle. Also provided is a retaining ring (11) integral with the containment body and inserted therein to guide the stem in its travel within the containment body.

19 Claims, 7 Drawing Sheets

(56) References Cited

U.S. PATENT DOCUMENTS

| | | | | |
|---|---|---|---|---|
| 7,819,291 | B2 * | 10/2010 | Schulte et al. | 222/321.9 |
| 2007/0045348 | A1 * | 3/2007 | Schulte et al. | 222/321.9 |
| 2008/0035678 | A1 * | 2/2008 | Lee | 222/320 |
| 2008/0251537 | A1 * | 10/2008 | Kuo | 222/153.13 |
| 2009/0020565 | A1 * | 1/2009 | Nicolle et al. | 222/394 |
| 2009/0314805 | A1 * | 12/2009 | Ding | 222/153.13 |
| 2010/0176158 | A1 * | 7/2010 | Carta | 222/321.9 |
| 2010/0219209 | A1 * | 9/2010 | Ding | 222/321.9 |
| 2010/0230443 | A1 * | 9/2010 | Ding | 222/321.9 |
| 2011/0297700 | A1 * | 12/2011 | Santagiuliana | 222/153.13 |
| 2012/0024909 | A1 * | 2/2012 | Carta | 222/321.9 |

FOREIGN PATENT DOCUMENTS

| | | | |
|---|---|---|---|
| JP | 2005/046754 | A | 2/2005 |
| JP | 2009/208830 | A | 9/2009 |
| WO | 99/02446 | A1 | 1/1999 |

* cited by examiner

DISPENSER WITH LIQUID FILM BLOCKING CAPABILITY

TECHNICAL FIELD

The present invention relates to a dispenser, i.e. a dosing device able to be applied to the neck of a bottle to dispense the liquid contained therein.

BACKGROUND ART

In particular, the present invention relates to a dispenser of the type comprising a containment body with substantially axial-symmetric geometry, internally hollow and able to be inserted in the neck of a bottle.

The containment body is fastened to a threaded ring nut which is screwed onto the neck of a bottle.

In particular, the containment body comprises an annular portion facing an annular portion of the ring nut and fastened thereto.

The containment body is provided in a first end of an orifice for the entry of the liquid product present in the bottle. Said orifice is opened or closed by a valve, slidably movable within the containment body, in particular within a dosing chamber included therein.

The dosing chamber is defined by the space present between a piston, guided by an internally hollow stem, able to slide within the containment body and the bottom portion (where the orifice is positioned) of the containment body.

Between piston and stem are present means for opening and closing the inner cavity of the stem in such a way as selectively to place in fluid communication the interior of the stem with the dosing chamber.

The stem is guided in its travel by a retaining ring, integral with the containment body, which also serves as an abutment for the travel of the piston.

In other words, the retaining ring defines the upper limit of the dosing chamber, preventing the piston from being able to exit from the dosing chamber itself.

When the piston creates an overpressure within the dosing chamber, the cavity of the stem is in fluid communication with the dosing chamber and the fluid present in the dosing chamber rises along the stem and is dispensed by a spout associated therewith.

In this configuration, the valve is lowered and occludes the aforementioned orifice because of the overpressure in the dosing chamber.

When the piston creates a vacuum within the dosing chamber the cavity of the stem is not in fluid communication with the dosing chamber and fluid is moved from the bottle into the dosing chamber.

In this configuration, the valve is raised and leaves open the aforementioned orifice because of the vacuum in the dosing chamber.

In this type of dispenser, the sliding of the piston within the containment body takes place contrasting the action of a spring whose function is to maintain the piston in raised position.

In particular, when a compression action is exercised on the stem, the piston slides within the dosing chamber, reducing its dimensions and hence creating an overpressure within it.

Ceasing the compression action on the stem, the aforementioned spring brings the piston back to the raised position, expanding the dimensions of the dosing chamber and hence creating a vacuum therein.

The pressure action on the stem is exerted on the dispensing spout located at the upper end of the stem and in fluid communication therewith to dispense into the external environment the liquid contained in the bottle.

Clearly, at each dispensing action a volume of air equal to the dispensed liquid must enter the bottle to maintain a pressure equilibrium between the interior of the bottle and the outside atmosphere.

For this purpose, in prior art dispensers between the fastening ring nut and the dispensing spout that emerges from it there is a fluid blow-by, i.e. an inlet passage for air, in such a way that air from the external environment can flow into passages created within the containment body.

In particular, such passages assure that the air that blows by between spout and ring nut can reach a hole drilled on the outer surface of the containment body that is located inside the bottle.

Said passages place in fluid communication the external environment with the aforementioned hole when the piston is in lowered position, i.e. when the piston is returning upwards within the dosing chamber.

In this way, the liquid drawn from the bottle in the dosing chamber is replaced by air injected into the bottle.

When the piston is in raised position, the openings occlude the fluid communication between the external environment (i.e. between the air inlet) and the interior of the bottle (i.e. the hole drilled in the containment body).

The prior art dispensers described above present some drawbacks.

In particular, under heavy water spray conditions, e.g. under a shower, a film of water is created that coats the upper part of the dispenser (i.e. the part bearing the spout) directly exposed to the water spray.

Therefore, when the dispenser is operated, through the blow-by between spout and ring nut water is also injected into the containment body, in addition to air.

The water that enters the containment body follows the same path as air and, through the aforementioned openings, it reaches the interior of the bottle where it mixes with the liquid contained therein.

This causes the dilution with water of the liquid contained in the bottle which, following prolonged uses of the dispenser, may be found heavy and hence unacceptable.

Some prior art dispensers have overcome this problem by providing slidable, liquid-tight couplings between ring nut and spout. To prevent liquid blow-by, the tolerances between the two coupled elements must be minimal, but this has the disadvantage of risking the seizing of the parts, unless extreme precision is assured in the dimensioning of the mutually sliding components or an additional connecting component is used.

An additional drawback, which often occurs among prior art dispensers, is the possible pollution of the product because of possible corrosive phenomena that may involve the metal parts in contact with the product to be dispensed, in particular the return spring.

In the prior art, there are systems that have partly overcome this drawback, placing the spring outside the work chamber. There are multiple solutions, according to the different purposes to be achieved. Each of the existing solutions, however, is subject to limitations or cause particular drawbacks.

DISCLOSURE OF INVENTION

In this context, the technical task at the basis of the present invention is to propose a dispenser that overcomes the aforementioned drawbacks of the prior art.

In particular, an object of the present invention is to make available a dispenser that is structurally simple, modular and that is enables a simple and effective assembly.

Moreover, an object of the present invention is to provide a dispenser that has contained dimensions, that is light to use and economical to manufacture.

Lastly, an object of the present invention is to provide a dispenser that prevents water dilution of the liquid contained in the bottle even when it is used under heavy water spray, without having to couple mutually sliding parts that are subject to seizing.

The specified technical task and the objects set out above are substantially achieved by a dispenser, comprising the technical characteristics exposed in one or more of the appended claims.

DESCRIPTION OF THE DRAWINGS

Further characteristics and advantages of the present invention shall become more readily apparent from the indicative, and therefore not limiting, description of a preferred but not exclusive embodiment of a dispenser, as illustrated in the accompanying drawings in which.

DESCRIPTION OF THE ILLUSTRATIVE EMBODIMENT

With reference to the accompanying drawings, a dispenser in accordance with the present invention is indicated with the number 1.

Figure 6:
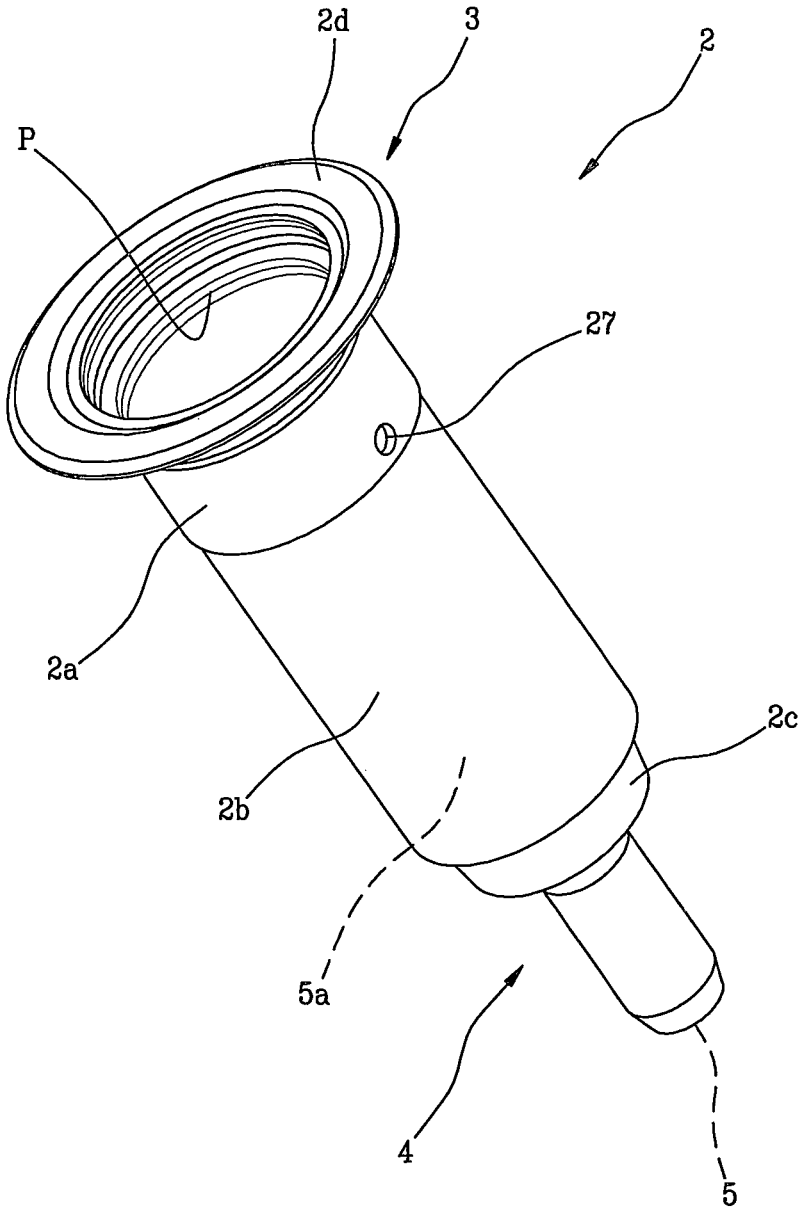
FIG. 6 is a perspective view of a third component of the dispenser of FIG. 1.

The dispenser 1 comprises a hollow containment body 2 (FIG. 6) able to be inserted in a bottle.

The containment body 2 has axial-symmetric geometry and it comprises a top portion 3 and a bottom portion 4, having geometries with different diameter.

The containment body 2 presents substantially funnel-like geometry.

The upper portion 3 of the containment body 2 is open and its function is to enable the insertion into the hollow body 2 of the elements (described farther on) which comprise the dispenser 1.

The bottom portion 4 is provided with an orifice 5 through which the liquid contained in the bottle enters the containment body 2.

A valve 6 (FIG. 1) appropriately positioned inside the containment body 2 at the base of the bottom portion 4 opens and shuts the orifice 5 in manners clarified further on.

In particular, the containment body 2 comprises a first section 2*a* that develops starting from the upper portion 3 towards the bottom portion 4, and a second section 2*b* positioned underneath the first section 2*a*.

The second section 2*b* defines a dosing chamber 5*a* for the dispenser 1.

Underneath the dosing chamber 5*a* develops a third section 2*c* from which the orifice 5 extends.

The three aforementioned sections have mutually different transverse dimensions, in such a way as to define the aforesaid funnel configuration of the containment body 2.

In particular, the second section 2*b*, the one defining the dosing chamber 5*a*, is substantially cylindrical.

Figures 1, 2:
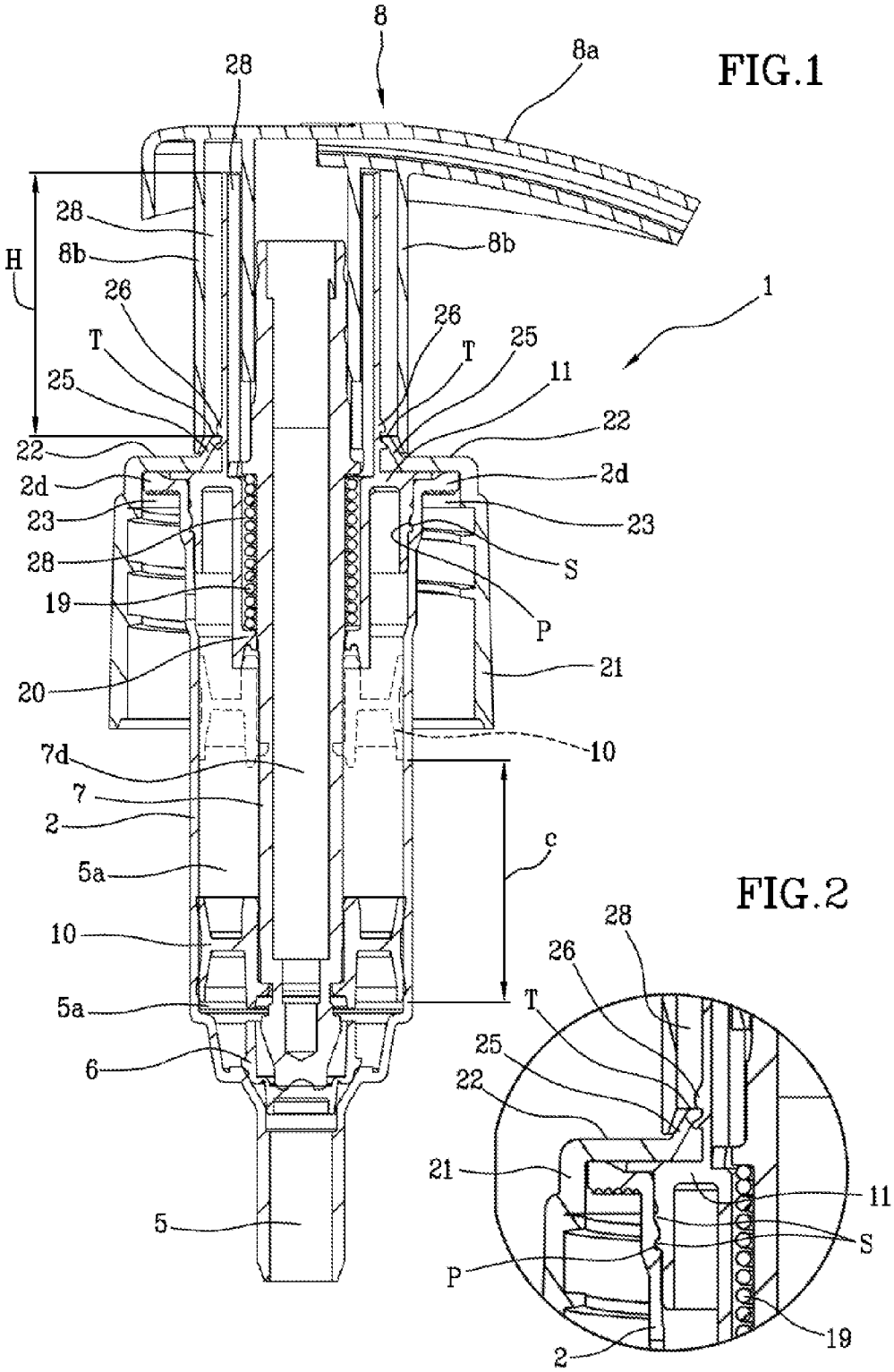
FIG. 1 shows a sectioned view of a dispenser in accordance with the present invention in an operative configuration.
FIG. 2 is an enlarged view of a detail of the dispenser of FIG. 1.
Figure 7:
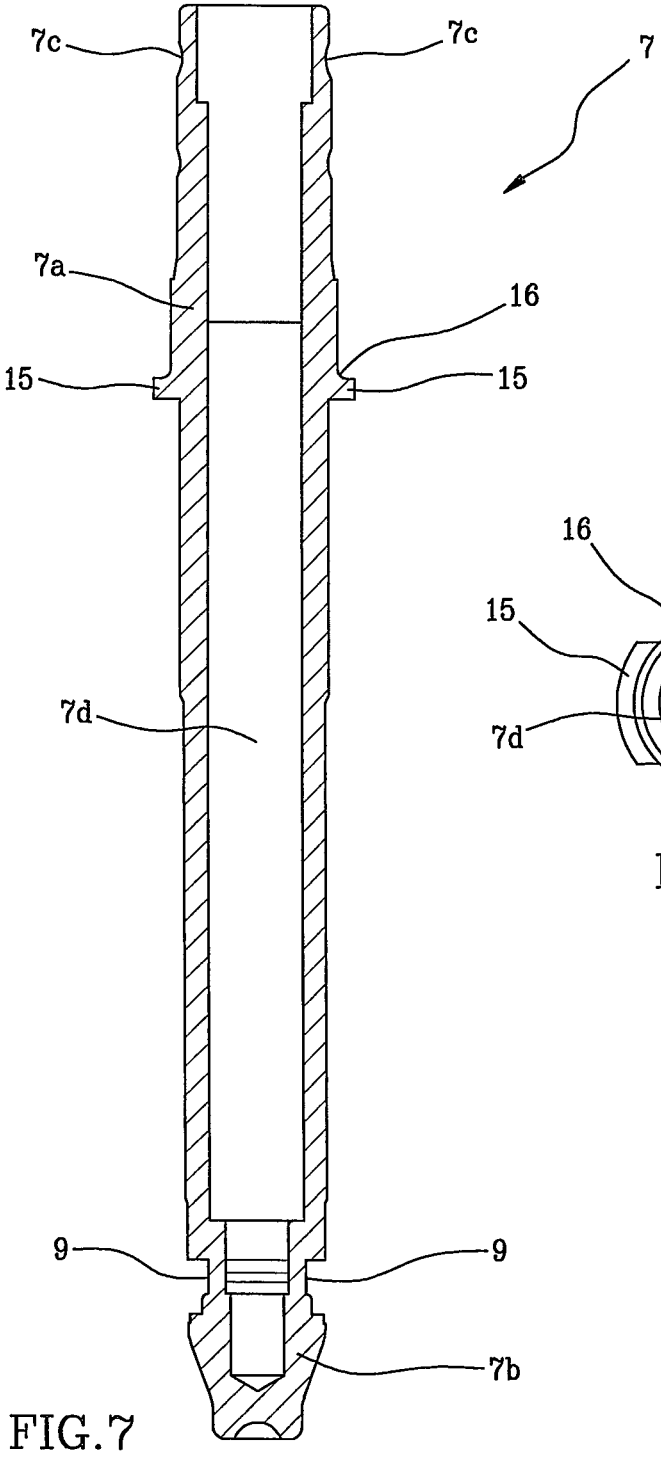
FIG. 7 is a sectioned view of a fourth component of the dispenser of FIG. 1.
Figure 8:
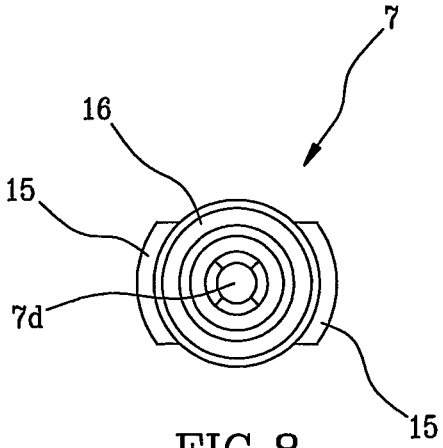
FIG. 8 is a plan view of the component shown in FIG. 7.

The dispenser 1 comprises a hollow stem 7 (FIGS. 7 and 8) able to slide axially within the containment body 2 between a raised position (not shown) and a lowered position (FIG. 1).

The stem 7 also serves the function of transferring, through its cavity, the liquid present inside the dosing chamber 5*a* to a spout 8 that dispenses the liquid to a user.

The spout 8 presents a head 8*a* and a cylindrical body 8*b* that extends from the head 8*a* downwards, i.e. towards the bottle.

In particular, the stem 7 comprises at least one window 9, preferably two mutually opposite windows, to place selectively in fluid communication the cavity of the stem 7 with the interior of the containment body 2, in particular with the dosing chamber 5*a*.

The windows 9 are obtained on the lateral wall of the stem 7.

The terminal part of the stem 7 is therefore closed, in such a way that the liquid in the dosing chamber 5*a* can enter the cavity of the stem 7 only through the window 9. Within the hollow body 2 is provided a piston 10 movable between a raised position (not shown) and a lowered position (shown in FIG. 1).

The stem 7 commands the operation of the piston 10, i.e. it actuates the piston 10 within the dosing chamber 5*a*.

The stem 7 is associated inferiorly to the piston 10 and superiorly to the dispensing spout 8, to command the operation of the piston 10 and dispense the fluid contained in the bottle.

The piston 10 comprises an outer surface able to contact the inner wall of the dosing chamber 5*a*.

The outer surface of the piston 10 slides within the dosing chamber 5*a* between the aforementioned raised position in which the volume of the dosing chamber is greatest, and the aforementioned lowered position, in which the volume of the dosing chamber 5*a* is smallest.

In other words, the piston moves along a distance c delimited superiorly by the position of interference between the piston 10 and the retaining ring 11 and inferiorly by the position of interference between the stem and the valve 6 that opens and closes the orifice 5 of the containment body 2.

The outer surface of the piston 10 slides providing fluid tightness along the inner wall of the containment body 2, in such a way that the liquid present in the dosing chamber 5*a* cannot escape through the sliding coupling between piston 10 and dosing chamber 5*a*.

The stem 7 is partially able to slide relative to the piston 10 in such a way that the window 9 is occluded or cleared by the piston 10.

In particular, the stem 7 is inserted in a through hole of the piston 10.

The stem is free to slide within the through hole by such a quantity as to make the window 9 emerge within the dosing chamber 5*a*.

In the preferred embodiment, the relative motion between stem 7 and piston 10 is delimited by upper and lower abutments positioned on the stem 7.

The stem presents an upper tubular part 7*a* and a lower head 7*b*. The tubular part 7*a* carries undercuts 7*c* on the top for engagement with the dispensing spout 8 and in its interior it defines a channel 7*d* for the passage of the liquid contained in the bottle, thereby placing in fluid communication the dosing chamber 5*a* with the dispensing spout 8.

Since the stem 7 and the spout 8 are connected to the piston 10, they are also movable along the aforesaid distance c.

The head 7*b* of the stem 7 is tapered and defined in such a way as to facilitate its assembly and coupling with the piston 10, with which it achieves water tightness during the upwards return movement.

Figure 3:
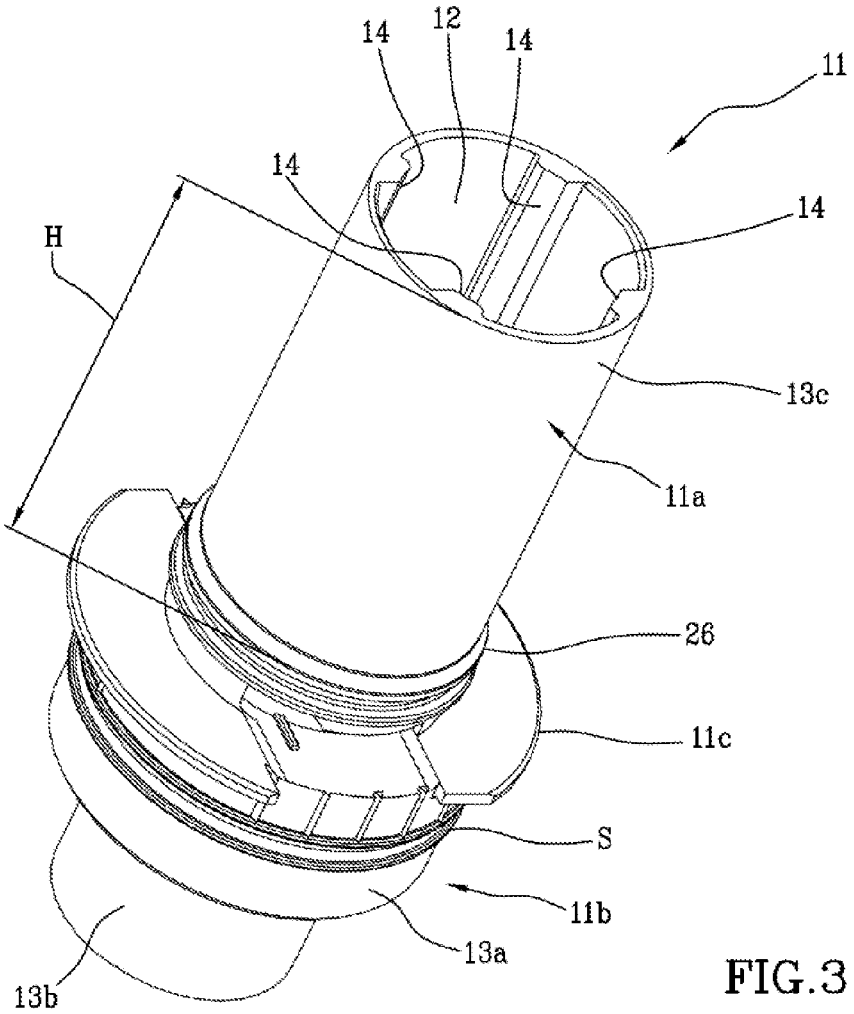
FIG. 3 is a perspective view of a first component of the dispenser of FIG. 1.
Figure 4:
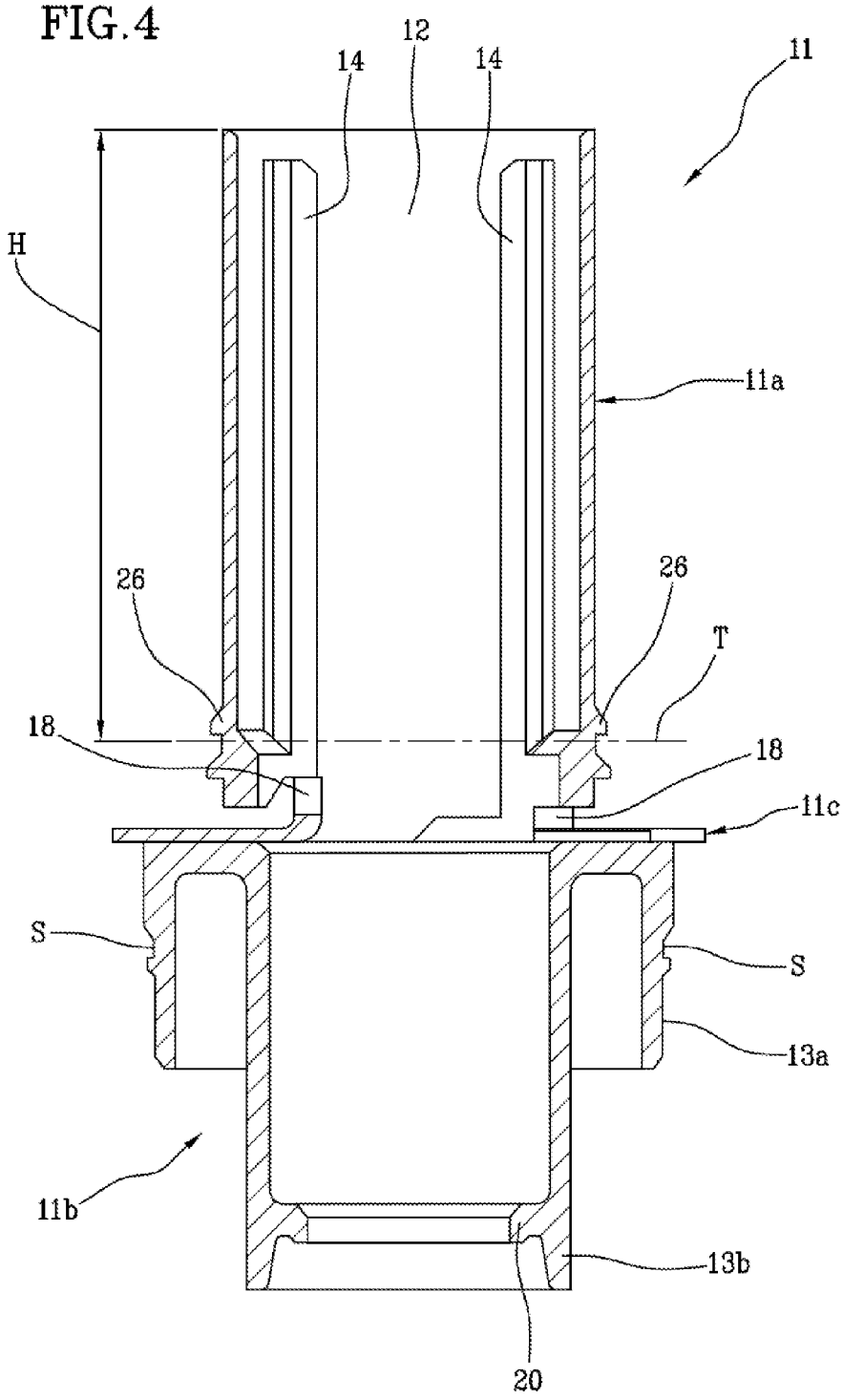
FIG. 4 is a sectioned view of the first component of FIG. 3.

To guide the stem 7 in its travel within the containment body 2, the dispenser 1 comprises a retaining ring 11 (FIGS. 3 and 4) integral with the containment body 2 and inserted therein.

The retaining ring 11 is positioned in the first section 2*a* of the body 2 and it has a hole 12 for the passage of the stem 7.

Appropriate undercuts S and projections P achieve the connection between ring 11 and body 2.

The retaining ring 11 presents an upper portion 11*a* and a lower portion 11*b* delimited by a flange 11*c*.

In particular, the retaining ring 11 presents, in the lower portion 11*b*, a first outer skirt 13*a* and a second inner skirt 13*b*, coaxial and having different diameters and axial heights and, in the upper portion 11*a*, a third skirt 13*c*, having axial height that is equal to or greater than the two skirts 13*a* and 13*b* present in the lower portion 11*b*.

Advantageously, the upper portion 11*a*, and hence the third skirt 13*c*, presents a height "H" equal at least to the distance c.

In this way, when the spout 8 is in the lowered position, shown in FIG. 1, the cylindrical body 8*b* is superposed to the upper portion 11*a* of the retaining ring 11 and it covers it completely, whilst when the spout 8 is in the raised position the cylindrical body 8*b* of the spout 8 is superposed, at least partially to said upper portion 11*a*.

In this way, water cannot enter from the hole 12 of the retaining ring 11.

Within the upper portion 11*a*, the retaining ring 11 presents at least two guides 14 for respective sliding fins 15, which project radially from an annular flange 16 of the stem 7.

Moreover, the retaining ring 11 presents internally, at the base of the guides 14, at least two undercuts 18, positioned at diametrically opposite sides, below which the fins 15 of the stem 7 are engaged by interference, to maintain the step in lowered position and the dispenser shut.

Said undercuts 18 further define windows that place in fluid communication the interior of the retaining ring 11 with the exterior.

The dispenser 1 comprises elastic means 19 to contrast the free sliding of the stem 7 (and hence of the piston) within the containment body 2.

Said elastic means, in the preferred configuration, shown in the figures, are constituted by a spring 19 housed between the retaining ring 11 and the stem 7.

The latter configuration is the preferred one, shown in the accompanying figures, and to which reference will be made hereafter without thereby impinging on the general nature of the description.

It should be noted that said configuration, so-called external spring, prevents contact between the liquid contained in the dosing chamber 5*a* and the spring itself, because it is positioned around the stem 7, isolated from the dosing chamber 5*a*.

The spring 19 is housed within a seat defined laterally by the stem 7 and by the inner skirt 13*b* of the retaining ring 11, superiorly by the flange 16 of the stem 7 and inferiorly by a radial narrowing 20 obtained internally and at the base of the skirt 13*b* of the retaining ring 11.

Between the radial narrowing 20 of the retaining ring 11 and the stem 7 a watertight seal is also achieved when the dispenser is in the operative configuration shown in FIG. 1, i.e. in the lowered closing position.

It should be noted that to assure the functions set out above, the skirt 13*b* has smaller dimensions than the skirt 13*c* extending in the upper part of the retaining ring 11. Such a configuration forces to obtain the undercuts 18 by complete shearing at least two sectors of the skirt 13*c* of the retaining ring 11. The undercuts 18 therefore consist of actual windows.

Pressing on the spout 8, the stem 7 and the piston 10 translate within the dosing chamber 5*a*.

In a first phase of said translation the piston 10 remains motionless because of the friction of the wall of the piston with the wall of the dosing chamber 5*a*.

In this phase the stem 7 translates relative to the piston 10 facing the window 9 (situated at the lower end of the stem 7).

The subsequent travel of the stem 7 drives with it the piston 10 determining a compression of the liquid present in the dosing chamber 5*a* which flows through the window 9 and hence through the spout 8 until it flows out to the exterior (operating configuration shown in FIG. 1). During this phase the spring 19 is compressed in its seat.

As a result of the release of the spout 8 by the user, the entire system returns to the resting position thanks to the thrust of the spring 19.

During the rising phase, the stem 7 moves before the piston 10 (held by the friction with the walls of the dosing chamber 5*a*) thereby closing the window 9.

In this way, the liquid present in the stem 7 and in the spout 8 is prevented from being aspirated into the dosing chamber 5*a* again.

The translation during the return travel of the piston 10 in the dosing chamber 5*a* creates a depression inside the dosing chamber 5*a* which determines the aspiration of liquid through the orifice 5 of the containment body 2.

As mentioned above, the containment body 2 can be inserted into the bottle.

To hold and fasten the containment body 2 inside the bottle, a threaded ring 21, which can be screwed onto the neck of the bottle, is provided.

The ring nut 21 comprises an annular shoulder 22 associated to, and covering, an annular lip 2*d* of the containment body 2.

The lip 2*d* of the containment body 2 is positioned in the upper portion 3 of the containment body 2 and it surrounds the upper opening of the containment body 2.

The annular shoulder 22 bears on the upper surface of the lip 2*d* and compresses the lip 2*d* against the edge of the neck of the bottle.

To prevent liquid present in the bottle from accidentally escaping, a gasket 23 is positioned between the annular lip 2*d* and the edge of the neck of the bottle.

The ring nut 21 further comprises a hole 24 to enable the insertion of the upper portion 11*a* of the retaining ring 11 in which the stem 7 slides.

The ring nut 21 is connected in sealed manner to the retaining ring 11 along an annular connecting line T. As shown in the accompanying FIGS. 1 and 4, the retaining ring 11 presents the aforementioned upper portion 11*a* that extends beyond the connecting line T, towards the dispensing spout 8, thus forming the third skirt 13*c*.

The sealed coupling between ring nut 21 and ring 11 takes place along the aforementioned annular connection line T, through the interference that occurs between an annular lip 25 of the ring nut 21 and an annular undercut 26 present on the outer lateral surface of the upper portion 11*a* of the sealing ring 11, at the base of the third skirt 13*c*, when the ring nut is screwed onto the bottle.

Said lip 25 rises from the shoulder 22 of the ring nut with cone frustum geometry, thereby defining an inclined surface that deviates the spraying water outwards.

The lip 25 is partially deformed during assembly to abut against the undercut 26. With this coupling, drops of spraying water are prevented from entering the dispenser.

Figure 5:
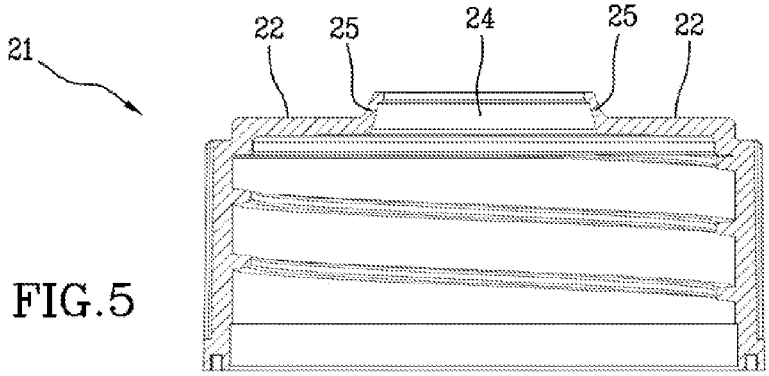
FIG. 5 is a sectioned view of a second component of the dispenser of FIG. 1.
Figure 5A:
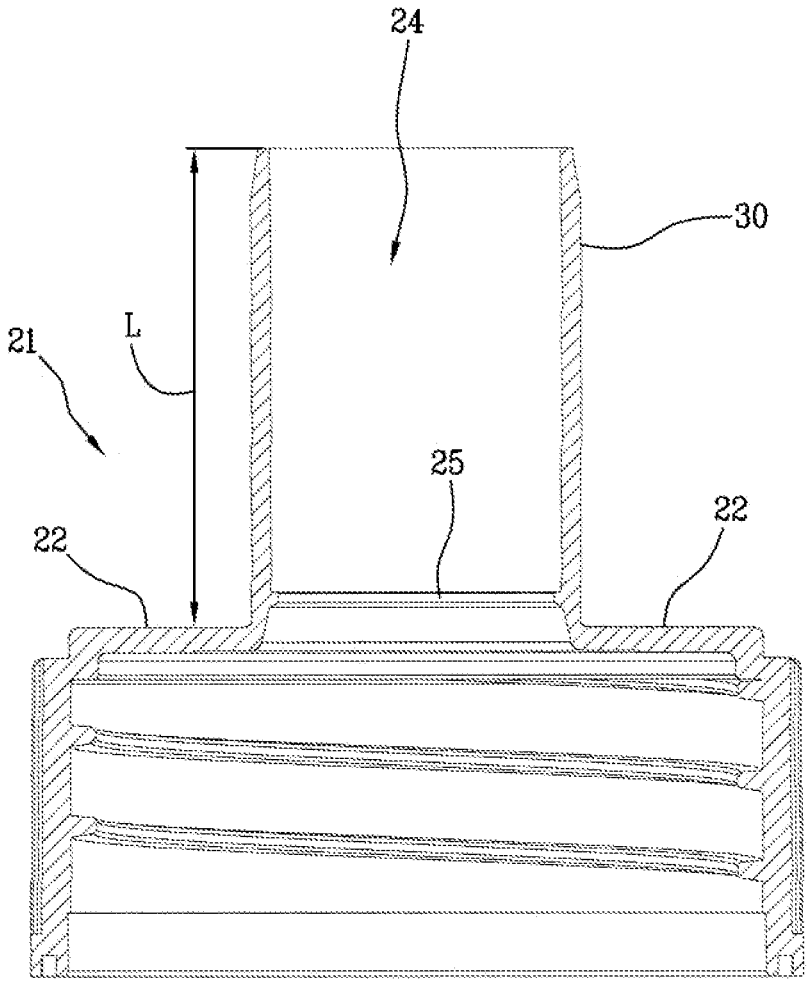
FIG. 5*a* is a first variant of the second component shown in FIG. 5.

A variation of this configuration is illustrated in FIG. 5*a*.

The ring nut 21, in this case, presents not only the lip 25 but also a collar 30 that rises from the shoulder 22 in axial direction.

In other words, the ring nut 21 comprises the collar 30 that extends from the shoulder 22 and surrounds the upper portion 11*a*, superposing at least partially on said upper portion 11*a* in the axial direction.

Preferably, the collar 30 extends throughout the height of the upper portion 11*a* of the retaining ring 11, therefore for a length "L" equal to the distance c. In this way, the skirt 13*c* of the retaining ring 11, i.e. the upper portion 11*a*, is completely covered thus preventing the possible entry of spraying water into the dispenser through the windows 18 or the other air passage ports.

The collar 30 then presents, along the annular connecting line T and projecting internally towards the centre, an annular sealing lip 25.

Similar to what takes place in the configuration described above and illustrated in FIG. 5, also said lip 25 abuts against the annular undercut 26 obtained externally on the retaining ring 11, to achieve the sealed connection between the ring nut 21 and the retaining ring 11.

Figure 5B:
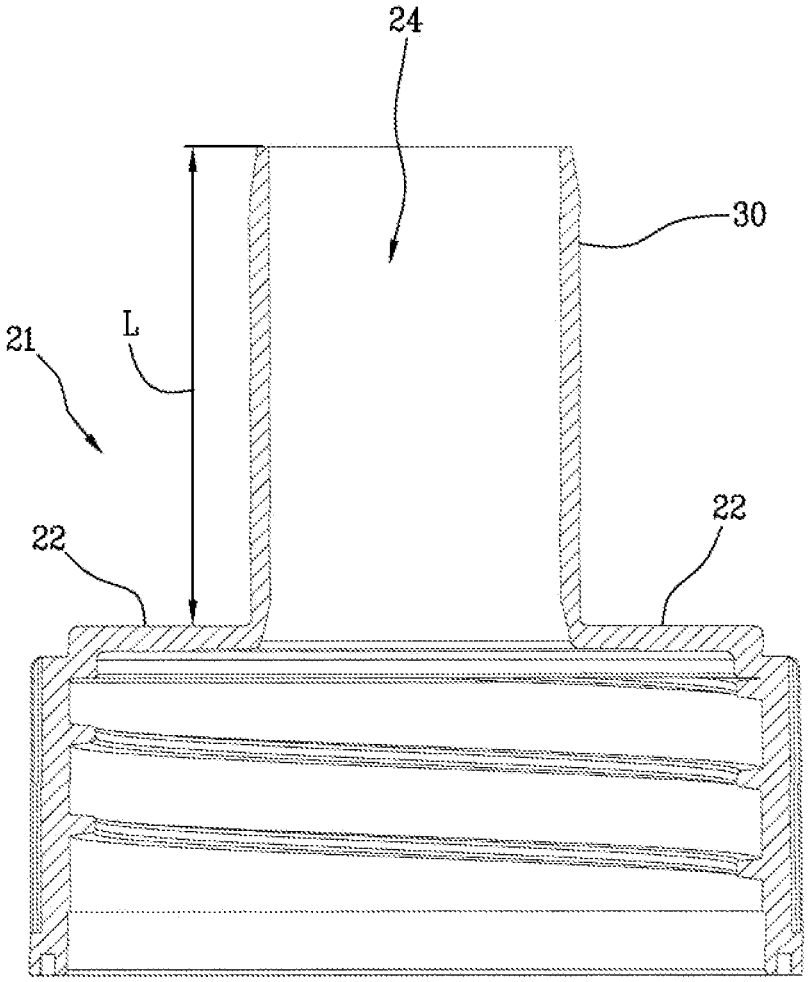
FIG. 5*b* is a second variant of the second component shown in FIG. 5.

In a second embodiment variation, illustrated in FIG. 5*b*, a ring nut is provided that comprises only the collar 30 extending in elevation from the shoulder 22. In this configuration, the sealing lip 25 is absent.

In this case, fluid tightness is achieved only by the presence of the collar 30 that extends upwards, for a height equal to the upper portion 11*a* of the retaining ring 11, to assure its coverage. The collar 30 is at least partially inserted into the cylindrical body 8*b* of the spout 8. In other words, the cylindrical body 8*b* always covers, at least partially, the collar 30, both with the spout raised and with the spout lowered, thus preventing the possible entry of spraying water into the dispenser through the windows 18 or the other air passage ports.

The dispenser 1 is constructed with the ring nut 21 shown in FIG. 5*b*, i.e. provided only with the collar 30, and it is structurally identical in every other part to the dispenser described above. In other words, the ring nut 21, shown in FIG. 5*b*, having the collar 30 alone, is applicable to the dispenser of the present invention.

FIG. 1 shows, for the sake of simplicity, the dispenser 1 provided with the ring nut 21 in accordance with the first embodiment shown in FIG. 5. With great ease, the ring nut 21 can be replaced with the ring nut shown in FIG. 5*a* or with the one shown in FIG. 5*b*.

At each dispensing operation, a volume of air equal to the dispensed liquid enters the bottle through a passage 28 that develops partially between spout 8 and retaining ring 11 and partially within the containment body 2, between stem 7 and retaining ring 11.

The passage 28 is placed in fluid communication with a hole 27 drilled on the containment body 2 and facing the interior of the bottle.

The upper portion 11*a* of the retaining ring 11 must necessarily extend beyond the connecting line T towards the dispensing spout 8 by an axial height equal at least to the height of the lateral wall of the dispensing spout, because the coupling of these two elements constitutes part of the aforementioned passage 28. In this way, the external environment is selectively placed in fluid communication with the interior of the bottle.

In this way, spraying water is prevented from entering the bottle, whilst the entry of air is allowed.

The passage 28 further extends between the retaining ring 11 and the stem 7.

The hole 27 in the containment body 2 is positioned between the retaining ring 11 and the piston 10.

It should be noted that the stem 7 slides without providing fluid tightness inside the retaining ring 11.

The retaining ring 11 is coupled in fluid tight fashion with the inner wall of the containment body 2.

When the dispenser 1 is in resting position (i.e. when the spout 8 is not pressed), the piston 10 is engaged in fluid tight fashion with the retaining ring 11, interrupting the passage 28 and hence preventing air from entering the bottle.

The invention achieves the proposed object.

The fluid-tight coupling between ring nut and retaining ring prevents the entry of water if the dispenser is used under spraying water.

Moreover, the extension of the retaining ring, and possibly of the ring nut, beyond the connecting line, towards the spout, achieves with the dispensing spout itself part of the passage that allows the entry of air into the bottle without allowing the entry of water.

The inlet passage that places in fluid communication the passage with the external environment is not directly exposed to the spraying water.

The presence of the external spring enables to prevent the contact of the liquid to be dispensed with the spring. Moreover, the spring is positioned around the stem and hence the diameter of the spring is smaller, reducing the weight of the dispenser.

The modularity of the dispenser enables a quick, simple and effective assembly.

The invention claimed is:

1. A dispenser, comprising:

a hollow containment body insertable into a bottle and comprising an orifice for suction of liquid from said bottle;

a ring nut screwable onto a neck of said bottle, comprising an annular shoulder covering and associated to an annular lip of said containment body;

a piston slidable within said containment body between a raised position and a lowered position, a dispensing spout having a head and a cylindrical body that extends downwards from the head;

a hollow stem axially slidable within said containment body, associated inferiorly to said piston and superiorly to said dispensing spout to command the actuation of said piston and dispense fluid contained in said bottle;

a retaining ring integral with the containment body and inserted within said body to guide the stem in its travel within the containment body, and said piston, said stem and said spout travelling a distance delimited superiorly by the position of interference between the piston and the retaining ring and inferiorly by the position of interference between the stem and a valve that opens and closes the orifice of the containment body, wherein said ring nut is connected in a sealed manner to said retaining ring along an annular connecting line, said retaining ring presenting an upper portion extending beyond said connecting line towards said dispensing spout at least by a height equal to said distance, wherein the cylindrical body of the dispensing spout is mounted around the upper portion of the retaining ring in such a way that i) when the dispensing spout is in a lowered position, the cylindrical body is superposed to the upper portion of the retaining ring and completely covers said upper portion of the retaining ring, and ii) when the dispensing spout is in a raised position, the cylindrical body of the dispensing spout is superposed, at least partially, to said upper portion of the retaining ring, wherein said ring nut comprises a collar extending in elevation from said shoulder, said collar surrounding said upper portion of said retaining ring and superposing to it at least partially in the axial direction, and wherein said collar presents internally, projecting towards the centre along said annular connecting line, an annular sealing lip, said lip abutting against an annular undercut obtained externally on said retaining ring to achieve said sealed connection between said ring nut and said retaining ring.

2. The dispenser as claimed in claim 1, wherein said sealing lip rises from said shoulder with cone frustum profile.

3. The dispenser as claimed in claim 1, wherein said sealing lip is partially deformable to be coupled by interference on the retaining ring, in such a way as to prevent the entry of water into the dispenser.

4. The dispenser as claimed in claim 1, wherein said collar extends axially for a length equal to the extension of said distance.

5. The dispenser as claimed in claim 1, further comprising: an external spring positioned around the stem.

6. The dispenser as claimed in claim 5, wherein said spring is housed within a seat defined between the stem and the retaining ring; said spring abutting against a radial constriction obtained at one end of the retaining ring and against an annular flange of the stem.

7. The dispenser as claimed in claim 1, wherein said retaining ring presents within the upper portion at least two guides for as many sliding fins that project radially from an annular flange of the stem.

8. The dispenser as claimed in claim 7, wherein said retaining ring presents internally, at the base of the guides of the upper portion, at least two undercuts underneath which the fins of the stem are engaged by interference.

9. The dispenser as claimed in claim 8, wherein said undercuts provide windows that place in fluid communication the interior of said retaining ring with the exterior.

10. The dispenser as claimed in claim 1, wherein said containment body comprises a hole which can face the interior of said bottle.

11. The dispenser as claimed in claim 10, further comprising:

at least one passage to place selectively in fluid communication an inlet passage for air from the outside environment with the hole in said containment body; said passage being obtained in part between said upper portion of said retaining ring and said spout and in part between said retaining ring and said stem.

12. A dispenser, comprising:

a hollow containment body insertable into a bottle and comprising an orifice for the suction of liquid from said bottle;

a ring nut screwable onto a neck of said bottle, comprising an annular shoulder covering and associated to an annular lip of said containment body;

a piston slidable within said containment body between a raised position and a lowered position;

a dispensing spout having a head and a cylindrical body that extends downwards from the head;

a hollow stem axially slidable within said containment body, associated inferiorly to said piston and superiorly to said dispensing spout to command the actuation of said piston and dispense fluid contained in said bottle;

a retaining ring integral with the containment body and inserted within said body to guide the stem in its travel within the containment body, said piston, said stem and said spout travelling a distance delimited superiorly by the position of interference between the piston and the retaining ring and inferiorly by the position of interference between the stem and a valve that opens and closes the orifice of the containment body, wherein said retaining ring presents an upper portion extending beyond said connecting line towards said dispensing spout at least by a height equal to said distance, and wherein said ring nut comprises a collar extending in elevation from said shoulder towards said dispensing spout, said collar surrounding said upper portion of said retaining ring and superposing thereon at least partially in the axial direction, wherein the cylindrical body of the dispensing spout is mounted around the upper portion of the retaining ring in such a way that i) when the dispensing spout is in a lowered position, the cylindrical body is superposed to the upper portion of the retaining ring and completely covers said upper portion of the retaining ring, and ii) when the dispensing spout is in a raised position, the cylindrical body of the dispensing spout is superposed, at least partially, to said upper portion of the retaining ring, and wherein said collar rises from said shoulder towards the spout for a length equal to the extension of said distance.

13. The dispenser as claimed in claim 12, further comprising:

an external spring positioned around the stem.

14. The dispenser as claimed in claim 13, wherein said spring is housed within a seat defined between the stem and the retaining ring; said spring abutting against a radial constriction obtained at one end of the retaining ring and against an annular flange of the stem.

15. The dispenser as claimed in claim 12, wherein said retaining ring presents within the upper portion at least two guides for as many sliding fins that project radially from an annular flange of the stem.

16. The dispenser as claimed in claim 15, wherein said retaining ring presents internally, at the base of the guides of the upper portion, at least two undercuts underneath which the fins of the stem are engaged by interference.

17. The dispenser as claimed in claim 16, wherein said undercuts provide windows that place in fluid communication the interior of said retaining ring with the exterior.

18. The dispenser as claimed in claim 12, wherein said containment body comprises a hole which can face the interior of said bottle.

19. The dispenser as claimed in claim 18, further comprising:

at least one passage to place selectively in fluid communication an inlet passage for air from the external environment with the hole in said containment body; said passage being obtained in part between said upper portion of said retaining ring and said spout and in part between said retaining ring and said stem.

* * * * *